United States Patent [19]

Aalderink

[11] Patent Number: 5,010,721

[45] Date of Patent: Apr. 30, 1991

[54] ARRANGEMENT FOR THE GENERATION OF A YARN HAVING FANCY TWISTS ARRANGED AND/OR FORMED AT RANDOM

[75] Inventor: Friedrich Aalderink, Greenville, S.C.

[73] Assignee: Eno Electronic GmbH, Fed. Rep. of Germany

[21] Appl. No.: 453,182

[22] Filed: Dec. 15, 1989

Related U.S. Application Data

[63] Continuation of Ser. No. 218,632, Jul. 13, 1988, abandoned.

[30] Foreign Application Priority Data

Jul. 14, 1987 [DE] Fed. Rep. of Germany ..... 3723243

[51] Int. Cl.[5] ..... D02G 3/36; D02G 3/34

[52] U.S. Cl. ..... 57/11; 57/91; 57/207

[58] Field of Search ..... 57/6, 11, 91, 207; 28/293

[56] References Cited

U.S. PATENT DOCUMENTS

| | | | |
|---|---|---|---|
| 3,438,194 | 4/1969 | Cerutti et al. | 57/91 X |
| 3,695,019 | 10/1972 | Lappage | 57/91 |
| 4,010,601 | 3/1977 | Anahara et al. | 57/6 |
| 4,069,656 | 1/1978 | Arai et al. | 57/6 |
| 4,124,973 | 11/1978 | Hense et al. | 57/6 X |
| 4,528,807 | 7/1985 | Durand | 57/6 |
| 4,663,927 | 5/1987 | Takemae et al. | 57/6 |

FOREIGN PATENT DOCUMENTS

| | | |
|---|---|---|
| 177009 | 4/1986 | European Pat. Off. . |
| 2616786 | 12/1976 | Fed. Rep. of Germany . |
| 2315554 | 1/1977 | France . |
| 2122229 | 1/1984 | United Kingdom . |

*Primary Examiner*—Joseph J. Hail, III

*Attorney, Agent, or Firm*—Lee, Mann, Smith McWilliams & Sweeney

[57] ABSTRACT

On a yarn, fancy twists arranged and formed at random shall be generated by a device added to the normal twisting device. To this end a fancy twist yarn thread is led through a pivotable fancy twist lever extending transversely to the moving direction of the basic yarn threads and is then led with the basic yarn threads to the cop of the twisting device. The fancy twist lever is deflectable by a fancy twist lever drive, such that the feed point of the fancy twist yarn thread moves along with the basic yarn threads. The fancy twist lever drive is controlled by an electronic control unit having a random generator.

1 Claim, 2 Drawing Sheets

ARRANGEMENT FOR THE GENERATION OF A YARN HAVING FANCY TWISTS ARRANGED AND/OR FORMED AT RANDOM

This application is a continuation of application Ser. No. 07/218,632, filed July 13, 1988, now abandoned.

TECHNICAL FIELD

The invention relates to an arrangement for the generation of a yarn having fancy twists arranged and/or formed at random, comprising a twisting device, with which basic yarn threads to be twisted are led through a central yarn thread guide at a passing speed and twisted by winding up on a fast rotating cop.

BACKGROUND ART

Yarns consist of basic yarn threads, which are turned around each other through a rotational movement and thus are twisted. To this end, arrangements are used, with which the basic yarn threads are fed by a central yarn thread guide and then wound up on a fast rotating conical winding body, the cop. During the winding process the basic yarn threads describe a conical surface and thus they are twisted with each other. This is a normal twisting arrangement.

It is often desirable to provide yarns with certain irregularities as naps or knots. These irregularities are described as "fancy twists". By such fancy twists a certain desired optical effect in the finished woven cloth or knitted fabrics is achieved. It is essential that the fancy twists occur in random sequences and that no periodicity occurs. In such a case, undesirable patterns ("figuring up") would appear during the weaving process of such a yarn.

U.S. Pat. No. 3,805,344, for example, discloses a texturing device wherein a yarn thread is guided in temporal sequence of different speeds for generation of irregular fancy twists.

DISCLOSURE OF THE INVENTION

It is the object of the invention to apply to a yarn fabricated by twisting a plurality of yarn threads fancy twists of the described type in one operating cycle with the twisting.

According to the invention this object is achieved in that at least one fancy twist yarn thread likewise is led on the cop through a fancy twist lever movable in the moving direction of the basic yarn threads and twisted with the basic yarn threads, and the fancy twist lever is movable by a fancy twist lever drive, which is controlled by an electronic control unit having a random generator.

With the arrangement according to the invention the fancy twist yarn thread of the twisting device is guided transversely to the moving direction of the "basic yarn threads" to be twisted and twisted therewith by means of the twisting device. When the fancy twist lever stands still and the fancy twist yarn thread is fed at the same feeding speed as the basic yarn threads, then the fancy twist yarn thread is normally twisted with the basic yarn threads. When, however, the fancy twist lever, for example, would be moved along the basic yarn threads to be twisted at such a speed that the point in which the fancy twist yarn thread is supplied moves at the feeding speed of the basic yarn threads, then the fancy twist is "wound up" virtually at one location of the yarn only, a small knot occurs. Between these extremities the cases are found, in which the point in which the fancy twist yarn thread is supplied moves more slowly than the basic yarn threads, such that a fancy twist extending over a certain length occurs. The parameters of the movement of the fancy twist lever and the moments of this movement are controlled through the electronic control unit by a random generator.

Thus, different fancy twists are generated. These fancy twists are at random with respect to shape and arrangement within given limits. The generation of the fancy twists is combined with the twisting of the yarn. The arrangement according to the invention is adapted to be mounted without difficulties on present twisting devices.

Modifications of the invention are subject matter of the sub-claims.

An embodiment of the invention will now be described in greater detail with reference to the accompanying drawings.

BEST MODE OF CARRYING OUT THE INVENTION

Figure 1:
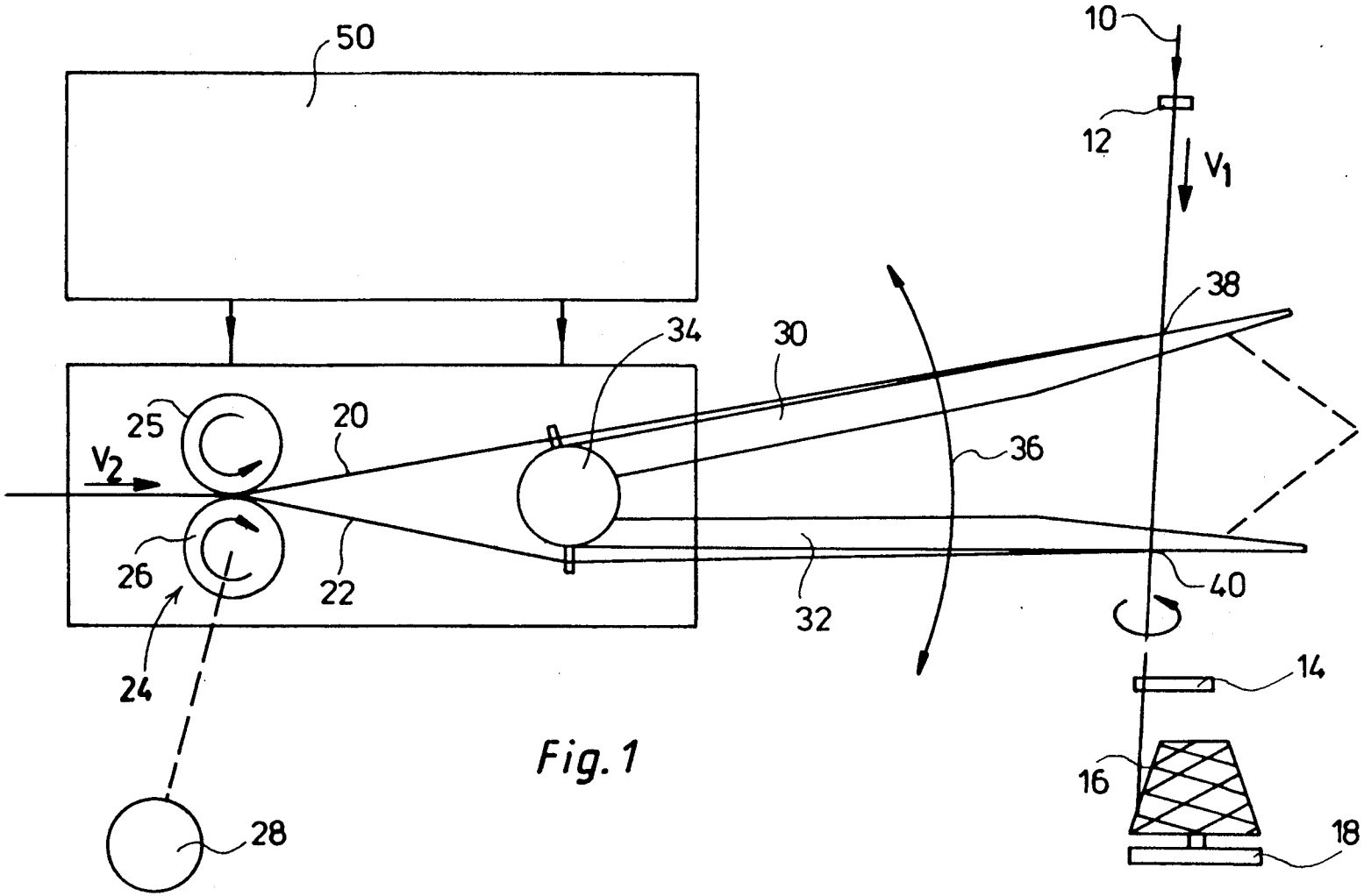
FIG. 1 is a schematical side view of an arrangement for generation of a yarn having fancy twists arranged and/or formed at random.

In FIG. 1 basic yarn threads are designated by 10, which basic yarn threads shall be twisted to a yarn. The basic yarn threads 10 are guided by an upper central yarn thread guide 12. The basic yarn threads 10 are fed at a passing speed $v_1$ of about 7 to 40 m/min. The basic yarn threads 10 are guided to a cop 16 by a lower yarn thread guide 14. That cop is a frustro-conical winding body, which is driven by a cop drive 18 at about 2500 to 5000 revolutions per minute. The upper yarn thread guide 12 is located approximately on the axis of rotation of the cop 16. Thereby the basic yarn threads 10 describe a conical surface and are turned around each other and twisted with each other. This is a common twisting device.

Fancy twist yarn threads 20 and 22 are now fed by a feed drive 24 at a feeding speed $v_2$. The feed drive is illustrated here by two rollers 25 and 26. The roller 26 is driven by a driving motor 28. The fancy twist yarn threads 20 and 22 are fed transversely to the moving direction of the basic yarn threads 10 through a fancy twist lever 30 and 32, respectively, and are twisted with the basic yarn threads 10. These fancy twist levers 30 and 32 are deflectable by a fancy twist lever drive 34, as indicated by the double arrow 36 in FIG. 1. Thereby the two points 38 and 40 in which the fancy twist yarn threads 20 and 22, respectively, are fed to the basic yarn threads 10 to be twisted can be displaced along the moving direction of these basic yarn threads 10. When the fancy thread lever 30 stands still and the feeding speed $v_2$ is equal to the passing speed $v_1$, then the fancy yarn thread 20 is normally twisted with the basic yarn threads 10. When the fancy twist lever 30 is pivoted clockwise by the fancy twist lever drive 34 at such an angular rate that the point 38 moves from the top to the bottom at the passing speed $v_1$, then the point 38 moves with the basic yarn threads 10. The fancy twist yarn thread 20 is always fed at the same place of the basic yarn threads 10 and of the yarn twisted thereof, and wound up on the basic yarn threads 10. Then a very concentrated knot occurs at this place. When the point 38 moves at a lower speed as the passing speed, then, on a finite section, a greater length of fancy twist yarn thread is fed per unit of length of the yarn as of the basic yarn threads. The fancy twist yarn thread 20 then forms a more or less elongated fancy twist. The fancy twist yarn thread 22 cooperates correspondingly with the fancy twist lever 32.

Figure 2:
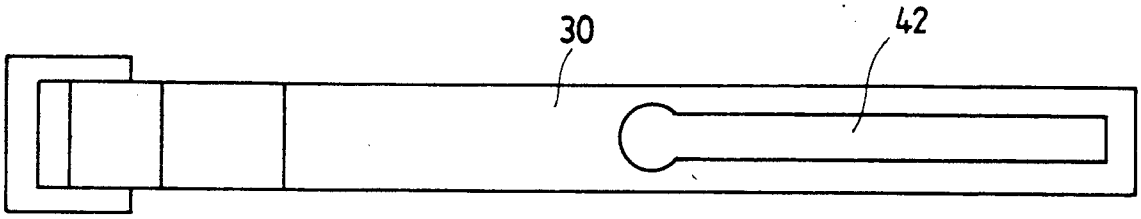
FIG. 2 is a plan view of the fancy twist lever in the arrangement of FIG. 1.
Figure 3:
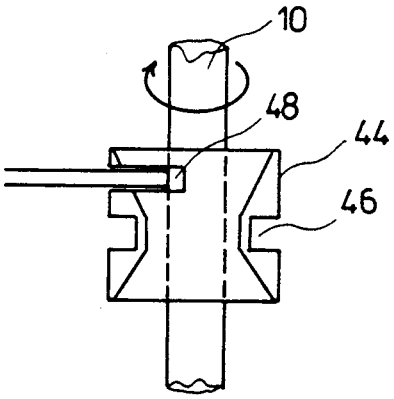
FIG. 3 is a side view of a yarn thread guide located in the fancy twist lever and movably guided along it.
Figure 4:
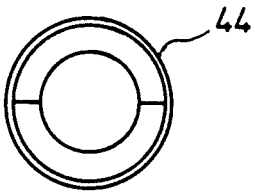
FIG. 4 is a plan view of the yarn thread guide.

If a yarn thread guide through which the fancy twist yarn threads are fed through would by fixedly attached to the fancy twist levers, problems can arise in that the fancy twist lever makes a pivotal movement. As can be seen from FIG. 2, the fancy twist lever 30 has a slot 42 extending in the longitudinal direction. A sleeve-shaped yarn thread guide 44 is movably guided in the slot 42 by means of a circumferential groove 46. The basic yarn threads 10 already twisted are led through the yarn thread guide 44 from the top to the bottom. The fancy twist yarn thread 20 is fed through a lateral slot 48. The fancy twist yarn thread 20 is twisted with the basic yarn threads 10 or wound around them during the rotational movement of the cop 16.

The fancy twist lever drives 34 and 35 and the feed drive 24 are controlled by an electronic control unit 50. The electronic control unit 50 comprises 9 random generator. Accordingly the control unit 50 randomly controls within certain given limits the feeding speed and the angular rate of the fancy twist levers 30 and 32 during the downward and upward movements and the moments of the speed variations and of the deflections of the fancy twist levers. Thus, the commanded downward speed is always located within a given useful speed interval but follows a random distribution within this speed interval.

I claim:

1. A device for producing a yarn having fancy twists arranged and/or formed at random, comprising (a) cop means rotatable about an axis of rotation for winding the yarn on a winding body and cop drive means for driving said cop means about said axis of rotation, (b) first thread guide means arranged approximately on said axis of rotation of said cop means for guiding basic yarn threads fed, said basic yarn threads being twisted by the rotation of said cop means to form a yarn and being wound on said winding body, (c) second thread guide means supported by holding means and arranged between said first thread guide means and said cop means and movable along said basic yarn threads, said basic yarn threads from said first thread guide means passing through said second thread guide means, wherein said holding means comprise a fancy twist lever extending laterally from said basic yarn threads between said first thread guide means and said cop means and being pivotally mounted about an axis extending crosswise to said basic yarn threads wherein said second thread guide means is movably guided longitudinally of said fancy twist lever, (d) means for feeding a fancy twist yarn thread, (e) means for guiding said fancy twists yarn thread through said second thread guide means to be twisted with the basic yarn threads due to the rotation of said cop, (f) a second fancy twist lever extending laterally from said basic yarn threads between said first thread guide means and said cop means and being pivotally mounted about an axis extending crosswise to said basic yarn threads, (g) third thread guide means supported by said second fancy twist lever, said basic yarn threads from said first thread guide means passing through said third thread guide means, (h) means for feeding a second fancy twist yarn thread, (i) means for guiding said second fancy twist yarn thread through said second thread guide means to be twisted with the basic yarn threads due to the rotation of said cop, (j) said third thread guide means being movably guided longitudinally of said second fancy twist lever (k) drive means for rocking said fancy twist levers substantially along said basic yarn threads and (l) electronic control means for controlling said drive means, said control means comprising random generator means, whereby the rocking of the fancy twist levers takes place at random, said first and second fancy twist levers being controlled independently from each other in accordance with random distributions.

* * * * *